US005286176A

United States Patent [19]

Bonin

[11] Patent Number: 5,286,176

[45] Date of Patent: Feb. 15, 1994

[54] ELECTROMAGNETIC PUMP

[75] Inventor: Richard L. Bonin, Newport, R.I.

[73] Assignee: The United States of America as represented by the Secretary of the Navy, Washington, D.C.

[21] Appl. No.: 58,018

[22] Filed: May 6, 1993

[51] Int. Cl.[5] ..... F04B 43/08

[52] U.S. Cl. ..... 417/413 R; 417/474; 417/477 R; 417/322

[58] Field of Search ..... 417/412, 413, 474, 475, 417/476, 477, 478, 322

[56] References Cited

U.S. PATENT DOCUMENTS

| | | | |
|---|---|---|---|
| 664,507 | 12/1900 | Singer | 92/144 |
| 1,759,766 | 5/1930 | Szmukier | 417/356 |
| 1,849,222 | 3/1932 | Canton | 417/410 B |
| 2,123,781 | 7/1938 | Huber | 417/476 |
| 2,250,947 | 7/1941 | Carpenter | 417/356 |
| 2,898,032 | 8/1959 | Katzenberger | 417/356 |
| 2,971,471 | 2/1961 | Huebschman | 417/412 |
| 3,279,388 | 10/1966 | Roudaut | 417/412 |
| 3,511,583 | 5/1970 | Brown | 417/412 |
| 3,768,931 | 10/1973 | Willis | 417/322 |
| 3,992,132 | 11/1976 | Putt | 417/271 |
| 4,441,867 | 4/1984 | Derfison | 417/475 |
| 4,515,534 | 5/1985 | Lawless et al. | 417/474 |
| 4,574,644 | 3/1986 | Lew et al. | 417/320 |
| 4,808,084 | 2/1989 | Tsubouchi | 417/478 |

FOREIGN PATENT DOCUMENTS

| | | | |
|---|---|---|---|
| 1610071 | 11/1990 | U.S.S.R. | 417/474 |
| 2238833 | 6/1991 | United Kingdom | 417/474 |

*Primary Examiner*—Richard A. Bertsch
*Assistant Examiner*—Peter Korytnyk
*Attorney, Agent, or Firm*—Michael J. McGowan; Prithvi C. Lall; Michael F. Oglo

[57] ABSTRACT

A pump having a stator that forms a cylindrical chamber defined by a wall and a plurality of independently energizable magnetic field generators. A compression roller comprising a magnetic material is disposed within the wall and is free to move with respect to the stator. A flexible diaphragm is intermediate the stator and the compression roller and disposed along the wall portion. The flexible diaphragm to be pumped has an input port and an outlet port for the fluid being pumped. An energizing control at any given instant energizes a plurality of adjacent ones of the magnetic field generators. The magnetic field generators are organized into overlapping sets that can be energized as sets in sequence thereby to produce a rotating, axially extending magnetic field within the wall. The compression roller follows the rotating field thereby to compress adjacent positions of the flexible diaphragm to pump fluid from the diaphragm through the inlet port to the outlet port.

22 Claims, 5 Drawing Sheets

ELECTROMAGNETIC PUMP

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to pumping systems and more specifically to self-contained pumping systems that provide a peristaltic pumping action.

(2) Description of the Prior Art

Conventional peristaltic pumps move fluid through a tubular diaphragm by peristaltic motion, i.e. by compressing a diaphragm at successive areas along its length thereby to move the fluid through the diaphragm in front of a point of compression. A typical peristaltic pump comprises a cylindrical chamber having a tubular, flexible diaphragm disposed circumferentially, i.e. in a loop, along an inner cylindrical wall of the chamber. Two end portions of the diaphragm provide inlet and outlet ports for fluid entering and leaving the pump. A compression roller mounted within the cylindrical chamber has a diameter that is smaller than the inner diameter of the cylindrical chamber. An external driver, typically an electric motor, drives the roller in a circular path about the axis of the cylindrical wall. As the compression roller moves along this path, it compresses the diaphragm at successive positions around the periphery of the diaphragm. Fluid trapped ahead of the compression point moves in the direction of rotation of the roller and exits under positive pressure through an outlet port. During one pumping cycle, a quantity of fluid enters the inlet port, is displaced through the diaphragm loop by the progressive compressive engagement of the roller against the diaphragm and exits from the outlet port.

The following patents disclose different embodiments of conventional peristaltic pumps:

U.S. Pat. No. 664,507 (1900), Singer
U.S. Pat. No. 2,123,781 (1938), Huber
U.S. Pat. No. 2,651,264 (1953), Bruckman
U.S. Pat. No. 3,279,388 (1966), Roudaut
U.S. Pat. No. 3,597,123 (1971), Lutz
U.S. Pat. No. 4,645,434 (1987), Bogen U.S. Pat. No. 664,507 to Singer discloses a peristaltic pump that compresses gases to liquids. The pump comprises concentric inner and outer cylindrical chambers. The outer chamber contains liquid coolant that condenses gaseous substances to liquid form as the substances are pumped through the inner chamber. A cylindrical diaphragm attaches at one position to the inner cylindrical cylinder to form a pumping volume. A compression roller mounts to a motor-driven shaft by means of a crank and is sized and positioned to compress one portion of the diaphragm and essentially divide the pumping volume into chambers. As an external motor rotates the shaft, the compression roller pump moves the compression position around the inner cylinder in a progressive fashion.

U.S. Pat. No. 2,123,781 to Huber discloses a peristaltic pump having a cylindrical housing. A series of cylindrical pins are disposed upon, and extend outwardly from, the periphery of a main oblong compression roller mounted in the center of the housing for rotation by an external motor. The oblong nature of the compression roller provides compression along a major axis. The pins provide increasing compression at successive areas along the length of the tubular diaphragm thereby to prolong the life of the diaphragm.

U.S. Pat. No. 2,651,264 to Bruckman discloses a pump having a looped tubular diaphragm and a compression roller disposed within a cylindrical housing. Like the apparatus shown in the Singer patent, an external motor drives a shaft and a crank that offsets the compression roller so that it moves on a circular path to move a compression position around the looped diaphragm.

U.S. Pat. No. 3,279,388 to Roudaut discloses a pump for corrosive liquids that comprises a cylindrical pump housing, a tubular diaphragm having magnetic rings disposed along its length, helical magnetic windings mounted on a shaft adjacent to the diaphragm, and a magnetically permeable partition between the diaphragm and rotating elements. When an external drive rotates the shaft, the rings along the length of the diaphragm are successively projected toward and away from the pump housing. This causes compression and expansion at successive positions along the length of the diaphragm. Consequently, fluid trapped between the diaphragm wall and the pump housing moves from an inlet port to an outlet port in a peristaltic fashion.

U.S. Pat. No. 3,597,123 to Lutz discloses a peristaltic pump with a cylindrical housing, a tubular flexible strip mounted within the casing and attached to the inner surface of the casing between the inlet and outlet ports, and a cylindrical compression roller rotatably mounted inside the strip. The circumference of the strip is smaller than the inner circumference of the casing. An external drive rotates a main shaft that carries a radial arm and a spring structure that supports the compression roller and biases it toward the cylindrical housing. This action forces a portion of the flexible strip against the housing to form two variable volume pumping chambers between the cylindrical housing and the flexible strip. Lutz also discloses a pump having two similar peristaltic pumps arranged side-by-side with their radial arms and rollers offset by 180° to increase pumping capacity.

U.S. Pat. No. 4,645,434 to Bogen discloses a peristaltic pump having a valve arm that reciprocates to close an outlet port at the end of each pumping cycle. In this pump, a radial arm and roller drive a circumscribing ring radially outward to engage successive portions of a tubular structure contained by a cylindrical housing.

The foregoing patents disclose pumping apparatus characterized by peristaltic pumping. That is, each apparatus operates by entrapping a volume of fluid and moving it by rotation of a constriction in a diaphragm. With some fluids, such as blood, resulting shear forces associated with the moving constriction can destroy the fluid. Other forces, most notably the forces required at the constriction to prevent backflow, can limit the useful life of the diaphragm. Each of these peristaltic pumps also requires an external motor drive. Such motor drives can, in some applications, increase noise associated with pumping beyond acceptable levels. In other applications the volume or area required for the pump and drive may exceed the space available.

The following patents disclose pumps that vary the volume of a pumping chamber without introducing excessive shear forces in the pumped fluid and without requiring an external motor drive.

U.S. Pat. No. 2,875,695 (1959), Justice

U.S. Pat. No. 3,768,931 (1973), Willis

U.S. Pat. No. 2,875,695 to Justice discloses a hydraulic pump comprising a cylindrical stator for generating a rotating magnetic field and a tubular coil carrying displaceable steel balls that are interspersed throughout the fluid to be pumped. The rotating magnetic field moves the balls through the tubular coil thereby pushing fluid contained in front of each ball through the coil to an output port.

U.S. Pat. No. 3,768,391 to Willis discloses an artificial heart. A pumping chamber comprises an inner flexible bag having a plurality of evenly-spaced magnets disposed on its outer surface and unidirectional inlet and outlet ports. An outer shell circumscribes the chamber and has a plurality of electromagnets. The magnetic field generated by each electromagnet interacts with a corresponding magnet on the inner bag. When electrical current is applied in one direction, the magnetic forces repel and collapse the bag forcing fluid from the interior of the bag. When current reverses, the magnetic fields attract and expand the bag to allow fluid to fill the bag. Pumping action is achieved by alternating the direction of current flow through the electromagnets.

Each of the Justice and Willis patents discloses a pump without an external drive. However, in each the pumping mechanism is more complex than the tubular diaphragm and compression roller found in peristaltic pumps. Moreover, as magnetic air gaps in each embodiment change during use due to physical structural limitations, the magnetic fields must change accordingly to produce a constant force. If energizing level of the electromagnets is to be constant, the electromagnets and power supplies must be selected for operation at the maximum air gap, even though the fields will, on average, be greater than needed.

The following patents disclose structures that provide both motive and pumping actions U.S. Pat. No. 1,759,766 (1930), Szmukler U.S. Pat. No. 1,849,222 (1932), Canton U.S. Pat. No. 2,898,032 (1959), Katzenberger In each of these references, a cylindrical stator generates a rotating magnetic field for turning a rotor structure. The rotor structure produces a variable volume pumping volume. In U.S. Pat. No. 1,759,766 to Szmukler, a hollow, tubular shaft is held stationary. As the rotor rotates about the shaft, cell-like plungers produce a pumping action. In U.S. Pat. No. 1,849,222 to Canton, a rotor mounts on an eccentric shaft and carries circumferentially spaced, axially extending, slidable plates that form rotary seals to sweep fluid from an input port to an output port. In U.S. Pat. No. 2,898,032 to Katzenberger, a rotor turns about a stationary shaft and carries an eccentrically mounted cylinder that forms a pumping volume. A radially extendible finger supported by a stationary shaft sweeps across the surface of the cylinder as it turns with the rotor.

The following patents disclose other embodiments of variable volume pumps:

U.S. Pat. No. 2,250,947 (1941), Carpenter

U.S. Pat. No. 3,992,132 (1976), Putt

U.S. Pat. No. 4,574,644 (1986), Lew et al.

U.S. Pat. No. 2,250,947 to Carpenter discloses a guiding block that holds radially expandable pole pieces and that mounts eccentrically in a stator. U.S. Pat. No. 3,992,132 to Putt discloses an externally driven rotary magnet that passes radially extending, magnetic plungers that reciprocated in pumping chambers. U.S. Pat. No. 4,574,644 to Lew et al. discloses a variable volume pump in which an externally driven magnet moves balls around a toroidal cavity.

Each of the foregoing two groups of references discloses variable volume pumps. Some are self-contained. That is, some provide the motive and pumping functions with common rotor components. Each housing requires some complicated sealing structure. Components also slide against each other, so each is subject to generating noise. None incorporates a peristaltic pumping action with its greater simplicity. None seems readily adopted for being the basic building block of a multistage pump.

SUMMARY OF THE INVENTION

Therefore it is an object of this invention to provide a self-contained pump that provides the advantages of a peristaltic pump.

Another object of this invention is to provide a self-contained pump that eliminates the need for a separate, external motor drive normally associated with a peristaltic pump.

Yet another object of this invention is to provide a pump that minimizes shear forces exerted on a fluid being pumped.

Still another object of this invention is to provide a pump that operates with minimal noise.

Still yet another object of this invention is to provide a pump that is capable of being incorporated in a multiple stage pumping apparatus.

Yet still another object of this invention is to provide a pump that is reliable and that is simple and inexpensive to construct.

These and other objects are attained in accordance with this invention by a pump having a stator means with a cylindrical wall portion extending along a pump axis. A plurality of electromagnetic field generators equally spaced about the stator produce magnetic fields within the wall portion parallel to the pump axis. The pump additionally includes a magnetic compression roller capable of motion in the stator about the pump axis. A flexible diaphragm is intermediate the stator and the magnetic compression roller for defining a pumping volume with an input port and an outlet port. When the individual electromagnetic field generators are sequentially energized in different overlapping sets, they produce magnetic fields that attract the magnetic roller toward the stator at one portion in a solenoid-like fashion and compress a corresponding portion of the flexible diaphragm against the wall. When overlapping sets of electromagnetic field generators are energized in sequence, the magnetic roller moves in a circular path about the pump axis and the location of the compression position of the diaphragm moves around the stator thereby to pump fluid through the pumping volume.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
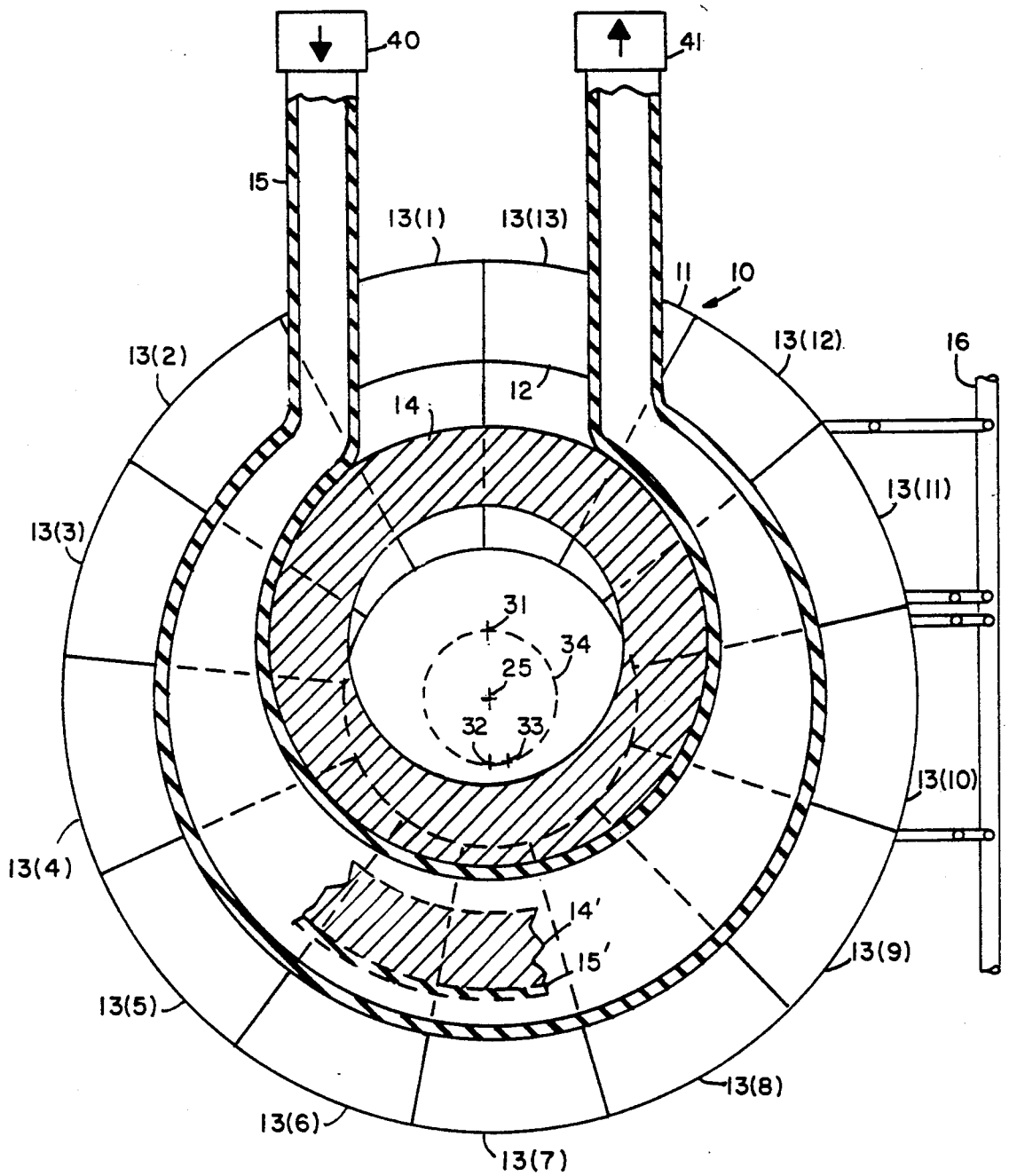
FIG. 1 is a view of a pump in accordance with this invention.

FIG. 1 discloses a pump 10 constructed in accordance with this invention. The major components of the pump 10 include a stator 11 that forms an internal wall surface 12 and that comprises a plurality of circumferentially spaced magnetic field generators 13(*i*) where $1 \leq i \leq n$ and "n" represents the maximum number of segments to be incorporated in the stator 11. In the specific embodiment of FIG. 1, n=13. A compression roller 14 moves about the interior of the stator to progressively compress one position along a flexible tube 15 that acts as a flexible diaphragm. A terminal strip 16 represents a structure for enabling electrical connections from each of the stator sections 13(*i*).

Figure 2:
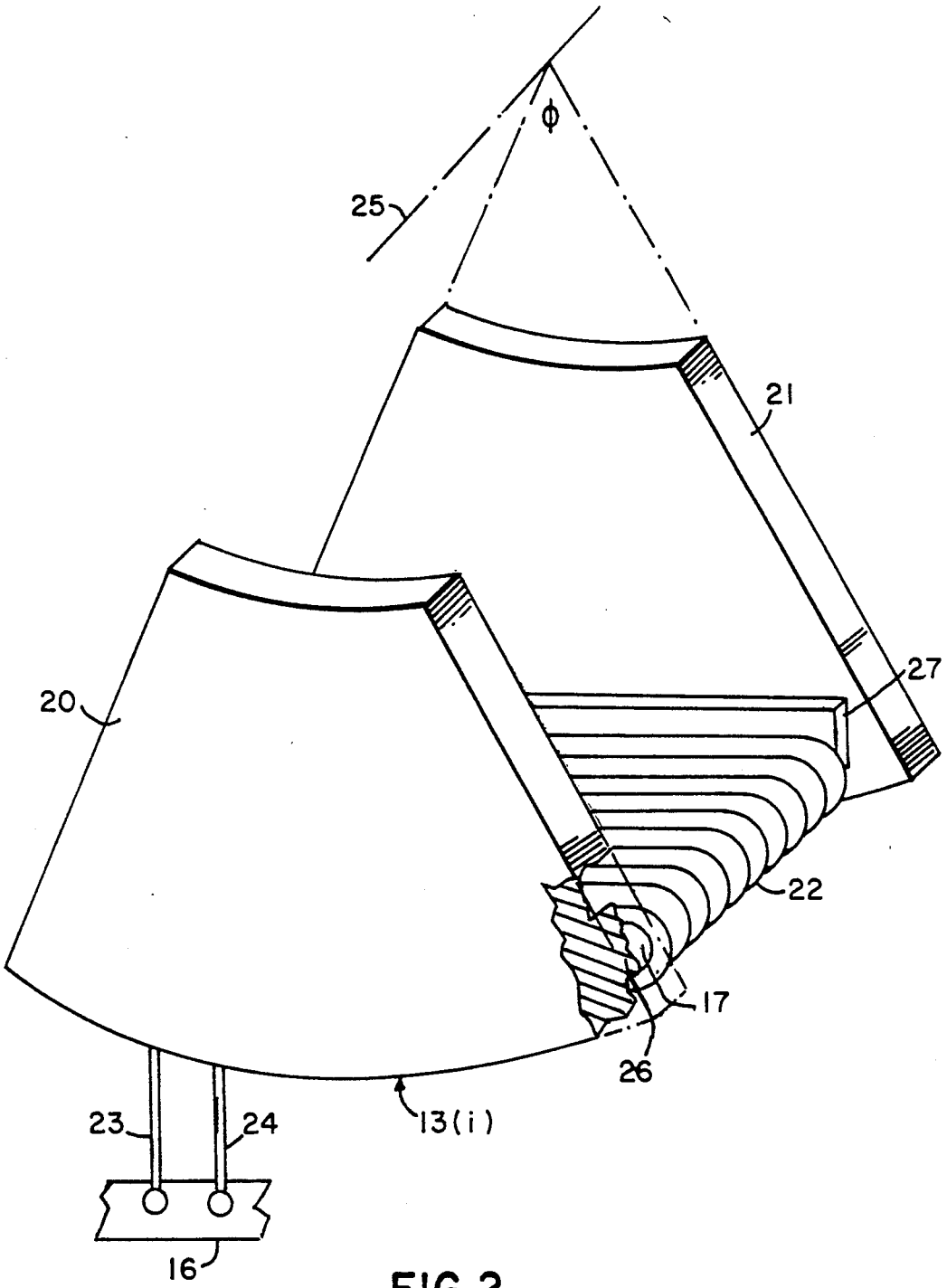
FIG. 2 is a perspective view of a stator segment useful in the pump of FIG. 1.

Each field generator 13(*i*) has an identical structure as shown in FIG. 2. Each comprises an axially extending circumferentially shaped coil support or core 17 and pie shaped end flanges or pole pieces 20 and 21 that extend radially from the core 17. The angle of $\phi$ formed by the radial edges of the pole pieces 20 and 21 is determined by the total number of field generators "n". i.e., $$\phi = \frac{360}{n} \tag{1}$$

In this specific example n=13, so $\phi=27.69°$.

Each core 17 carries a coil 22 with ends 23 and 24 that attach to the terminal strip 16. The pole pieces 21 and 22 produce an axial field that extends between the flanges 20 and 21 when the coil 22 is energized. If each of the coils 22 in each of the field generators 13(*i*) is independently controlled, then each segment can independently produce an incremental solenoid field parallel to a pump axis 25. More specifically the core 17 in FIG. 2 has axially extending end sections 26 and 27 that define, with the core 17, a coil form. Each end section 26 and 27, is integrally formed with its corresponding pole piece 20 or 21. This configuration minimizes flux densities in the field generator 13(*i*) thereby to avoid magnetic saturation problems. Other configurations might be used to accommodate whatever field strengths are involved in order to avoid any saturation effects.

Referring to FIG. 1, when a set of adjacent ones of the electromagnetic field generators 13(*i*) are energized simultaneously, they attract the compression roller 14. As shown in FIG. 1 the compression roller 14 is a cylinder. If the cylinder 14 were unrestrained and all the field generators 13(1) through 13(*n*) were energized simultaneously, the compression roller 14 would center itself on the pump axis 25. If, however, the field generators 13(1) through 13(3) and 13(11) through 13(13) are energized with the same polarity while the field generators 13(4) through 13(10) are not energized, the net magnetic field shifts the roller 14 upwardly as shown in FIG. 1 to be centered on an axis 31. The actual displacement depends upon the balance of the forces produced by the flexible diaphragm 15, any fluid in the diaphragm 15 and the strength of the field produced by the energized field generators 13(*i*).

Conversely, if only the field generators 13(4) through 13(10) are energized, the compression roller 14 shifts downwardly as shown in FIG. 1 to a position represented by the compression roller 14' and the flexible tube 15' shown in phantom. At this point the compression roller 14' would be centered on another axis 32. The axes 31 and 31 are diametrically opposed to the pump axis 25.

If the field generator 13(4) were deenergized and the field generator 13(11) were energized, the net magnetic field would shift counterclockwise and the compression roller 14 would center an axis 33. The loci of all the axes produced by difference energizations lie on a circular path shown by the dashed line 34. Consequently when the energization of one set of adjacent electromagnetic field generators, such as field generators 13(4) through 13(10), shifts to another, overlapping set of adjacent magnetic field generators, such as field generators 13(5) through 13(11), the compression roller 14 moves around the interior of the pump 10 and compresses an adjacent section of the diaphragm. If the energization of successive overlapping sets of adjacent field generators 13(*i*) continues, the compression roller 14 will compress successive positions of the diaphragm 15 and pump fluid through the pump 10.

Figure 3:
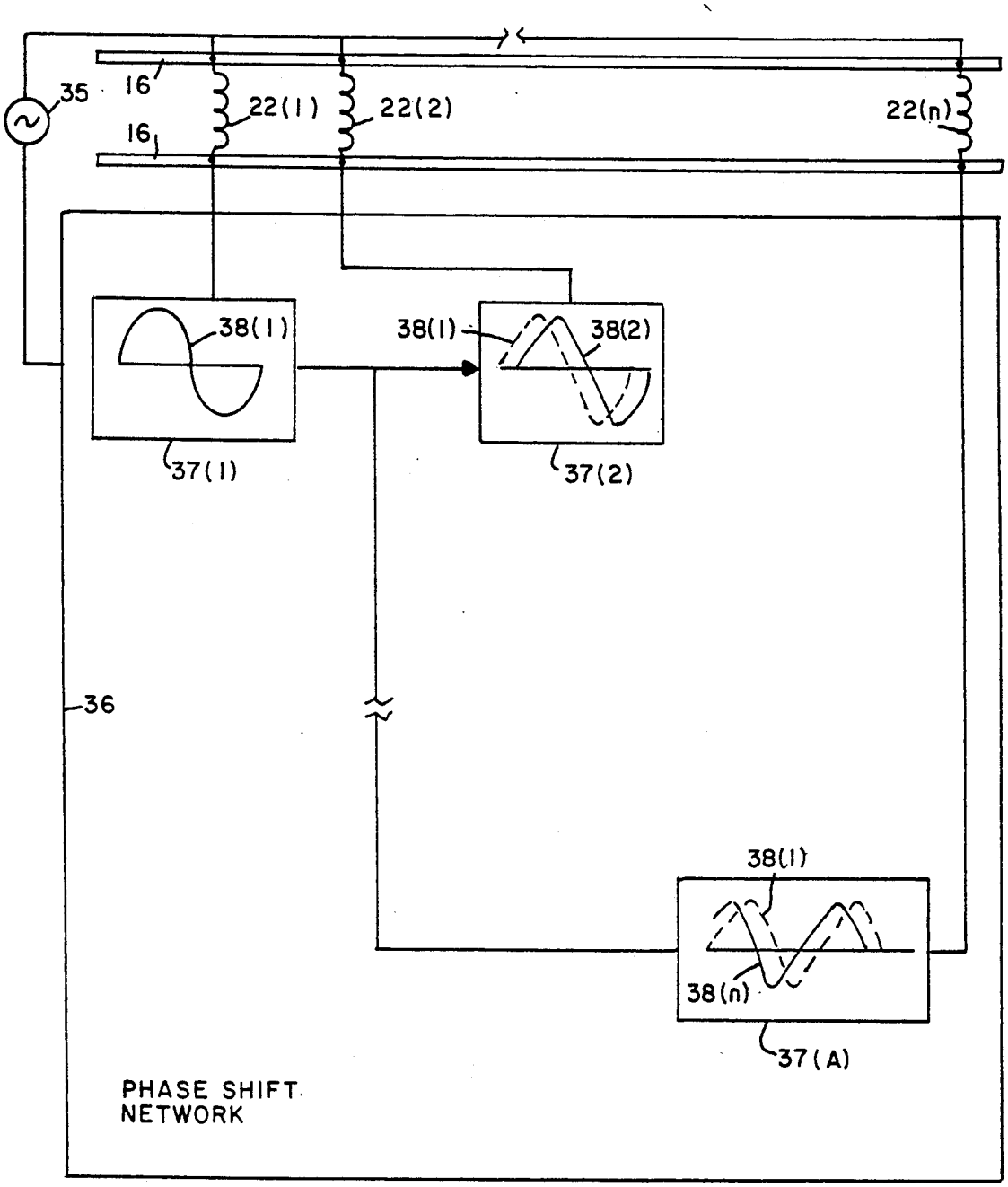
FIG. 3 is a simplified schematic of an electrical circuit for driving the pump of FIG. 1.

FIG. 3 depicts one embodiment of a circuit for energizing of the field generators, represented by coils 22(1), 22(2) and 22(*n*). These coils connect individually to terminals on the terminal strips 16. In this particular embodiment an AC source 35 energizes the coils 22(*i*) through a phase shift network 36 that is depicted functionally as including a plurality of phase shifters 37(*i*) designated by reference numerals 37(1), 37(2) and 37(*n*). Each of these produces a phase shift:

$$\Delta\phi(i) = \frac{360}{n}(i-1) \tag{2}$$

Using a sinusoidal wave shape 38 as a reference in each of the phase shift circuits 37(*i*), there is no relative phase shift in the signal phase shifting circuit 37(1) that drives the coil 22(1). A small phase shift or delay appears in the signal 38(2) and nearly a full cycle phase delay in the wave form 38(*n*) that drive the coils 22(2) and 22(3) respectively. Consequently and collectively the magnetic field has a sinusoidal field strength around the wall 12. At diametrically opposed portions the magnetic fields produced between the pole pieces of the field generators 13(*i*) have equal strength, but opposite direction.

If the compression roller 14, shown in FIG. 1, is formed of a permanent magnet material with a magnetic axis that parallels the solenoid field and the pump axis 25, the magnetic field and adjacent segments 13(*i*) repel the permanent magnet compression roller 14 while the magnetic fields generated by diametrically opposed segments attract the compression roller 14. As shown in FIG. 1, for example, the magnetic fields collectively generated by the field generators 13(4) through 13(10) would repel the permanent magnet compression roller 14 while the magnetic field produced by the remaining field generators would attract the permanent magnet compression roller. A half cycle later the magnetic fields reverse so the magnetic field produced by generators 30(4) through 30(10) attracts the permanent magnet compression roller 14 while the remaining field generators produce a magnetic field that repels the permanent magnet compression roller 14.

It is also possible to manufacture the compression roller 14 from other magnetic materials such as steel. In that event additional circuitry could be added to the schematic shown in FIG. 3 in the form of rectifiers so each coil 22(*i*) is energized for one half cycle. This produces magnetic fields of one polarity, but not the reverse polarity.

Referring to FIG. 1, the energization of one set of magnetic field generators such as the field generators 13(1) through 13(3) and 13(11) through 13(13) would be used to attract the compression roller 14 to the position 31 on the circle 34. Similarly, energizing only the field generators 13(4) through 13(10) would center the compression roller 14 on the axis 32. Sequentially energizing different overlapping set of the adjacent ones of the field generators would attract the compression roller 14 toward the wall 12 at successive positions to move the compression position around the wall 12 thereby to pump fluid through the flexible diaphragm 15.

In accordance with another alternative, switching circuits could individually couple a DC source to each of the coils selectively and independently and under computer control to establish the rate of at which the net magnetic field rotates around the axis 25 and therefore the pumping speed and to control the magnitude of the current through each coil and the number of field generators in a set of adjacent field generators thereby to control the compression force on the flexible diaphragm 15, assuming the compression roller 14 is free of any other constraint.

Still referring to FIG. 1, the flexible diaphragm 15 terminates with an input port and an output port. In FIG. 1 the input port and output ports include check, or one-way flow valves 40 and 41 respectively. Each valve enables flow in the direction shown by the arrow. As the compression roller 14 compresses the diaphragm 15, the check valve 40 prevents any backflow into the fluid source. Consequently rotation of the compression roller 14 advances fluid out of the pump 10 through the check valve 41 that prevents backflow into the pump 10. When these check valves are incorporated, it is not necessary to completely close the diaphragm 15. In FIG. 1 for example, the diaphragm 15' is shown as only being partially closed. As a result the pumping action occurs without introducing unnecessary shear forces to the fluid being pumped.

Figure 4:
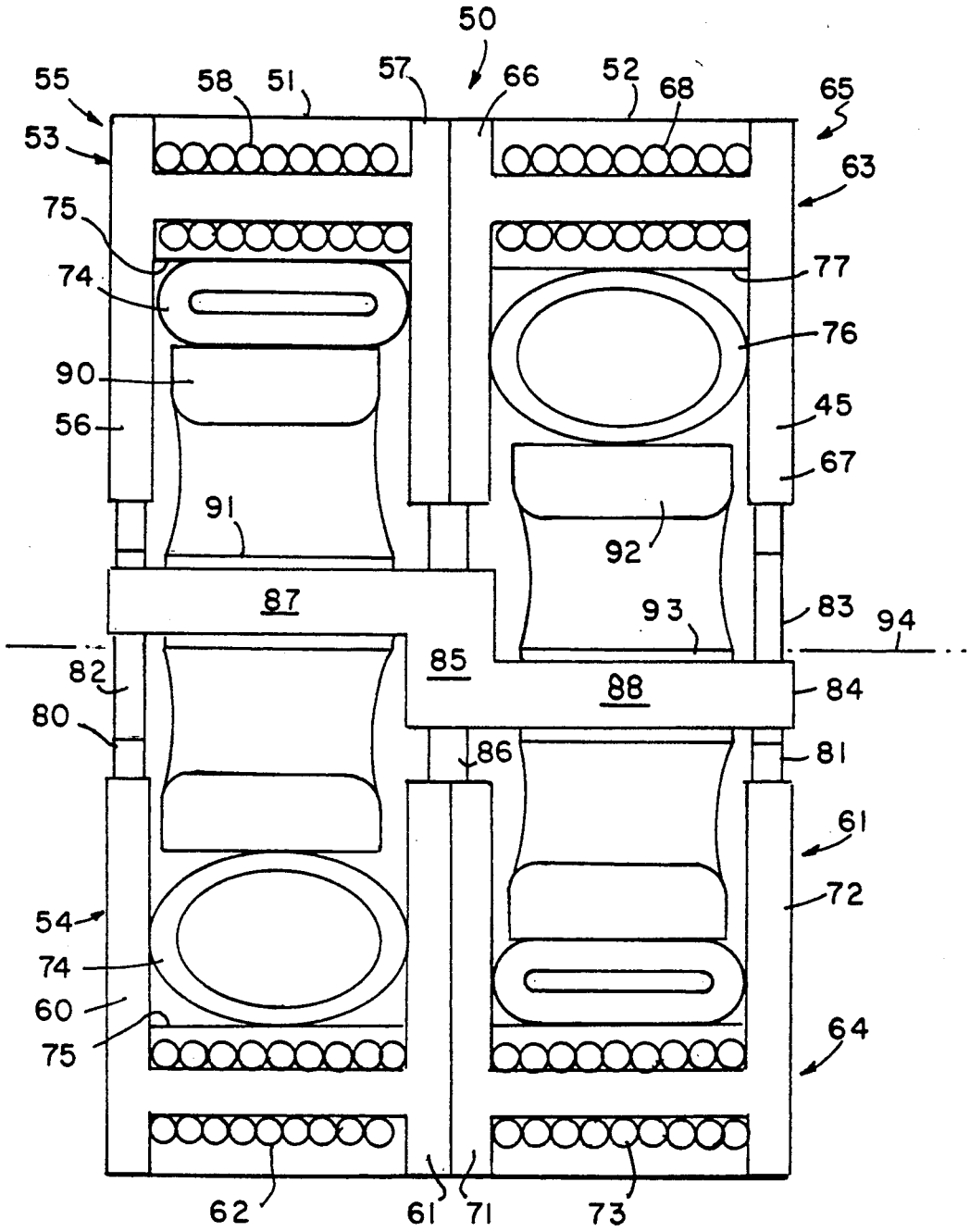
FIG. 4 is a sectional view that depicts a multistage pump based upon the pump shown in FIG. 1.

The components in the pump 10 shown in FIG. 1 are readily adapted for use in a multi-stage pump 50 as shown in FIG. 4 with two stages 51 and 52 each constructed along the lines of FIG. 1. The stage 51 comprises a series of magnetic field generators, magnetic field generators 53 and 54 are shown, that constitute a stator 55. Each magnetic field generator also has the same general form as that shown in FIG. 2. By way of example, the magnetic field generator 53 includes, as its major components, radially extending pie-shaped pole pieces 56 and 57 and a coil 58. Similarly the field generator 54 includes pole pieces 60 and 61 and a coil 62. The stage 52 includes field generators 63 and 64 as part of a stator 65. The field generator 63 has magnetic field pole pieces 66 and 67 and a coil 68. The oppositely disposed field generator 64 includes pole pieces 71 and 72 and a coil 73.

In each stage the pole pieces form an internal volume. For example, the pole pieces 56, 57, 60 and 61 form an internal cylindrical volume for carrying a flexible diaphragm 74 in stage 51 against a cylindrical wall surface 75 formed internally of each of the coils including coils 58 and 62. Stage 52 has a similar volume for carrying a flexible diaphragm 76 that abuts a cylindrical wall surface 77.

End bearings 80 and 81 are contained within the openings formed by the pole pieces, such as pole pieces 56 and 57 and by pole pieces 67 and 72 respectively. These end bearings 80 and 81 carry bearing supports 82 and 83 at each end of a crank shaft 84. A central crank 85 rotates in a bearing 86 centrally disposed of the radially inwardly ends of the pole pieces flanges 57, 61, 65 and 71. A crank pin 87 is located in the stage 51; a crank pin 88, in stage 52. The crank pin 87 carries a compression roller 90 that a bearing 91 mounts for rotation on the crank pin 87. Another compression roller 92 mounts to the crank pin 88 by means of a bearing 93. Consequently each of the compression rollers 90 and 92 are free to rotate about their respective axes through the crank pins 87 and 88. Moreover, the axes of the crank pins 87 and 88 rotate in a circle about a central axis 94 of the pump corresponding to the circular path 34 shown in FIG. 1.

FIG. 4 discloses a pump with two stages that are offset by 180°. The offset for any given number of stages "q" is:

$$\text{offset} = \frac{360}{q} \tag{3}$$

With two stages, this offset produces the relationship between the flexible diaphragms 74 and 76 as shown in FIG. 4. That is, the compression roller 90 has compressed the tube 74 against the wall 75 at the top of stage 51 while the offset compression roller 92 has compressed the tube 76 at the bottom of stage 92, i.e. at an offset of 180°.

In this particular construction each of the magnetic field generators such as magnetic field generators 53, 54, 63 and 64 produce solenoid fields that are parallel to the pump axis 94 and span the air gap between their respective pole pieces. As now will be apparent if the compression rollers 90 and 92 are made of magnetic material, such as steel, then the energization of the coil 58 and coils in adjacent field generators of a set and the energization of the coil 73 and coils in adjacent field generators of another set will cooperatively act to move the compression rollers 90 and 92 to the positions shown in FIG. 4. Likewise as will be apparent from the description of the operation of the pump in FIGS. 1 through 3, the act of sequentially energizing different overlapping sets of adjacent ones of said magnetic field generators in one stage with the sequential energization of different overlapping sets of adjacent electromagnetic generators in another stage that have the requisite offset will rotate the compression rollers 90 and 92 and the crank shaft 84 and thereby provide a pumping action in each stage.

Each stage additionally would include input and output ports corresponding to the input and output ports shown in FIG. 1. These could be all connected to a common manifold structure with techniques well known in the art. With this structure the crank shaft 84 constrains the motion and the displacement of the compression rollers 90 and 92 so the field strength does not control that radial displacement. Again, as shown in FIG. 4 at a maximum offset, each compression roller compresses its corresponding flexible diaphragm 74 and 76, but does not necessarily fully close this structure thereby minimizing the impact of any shear forces on the fluid being pumped.

Figure 5:
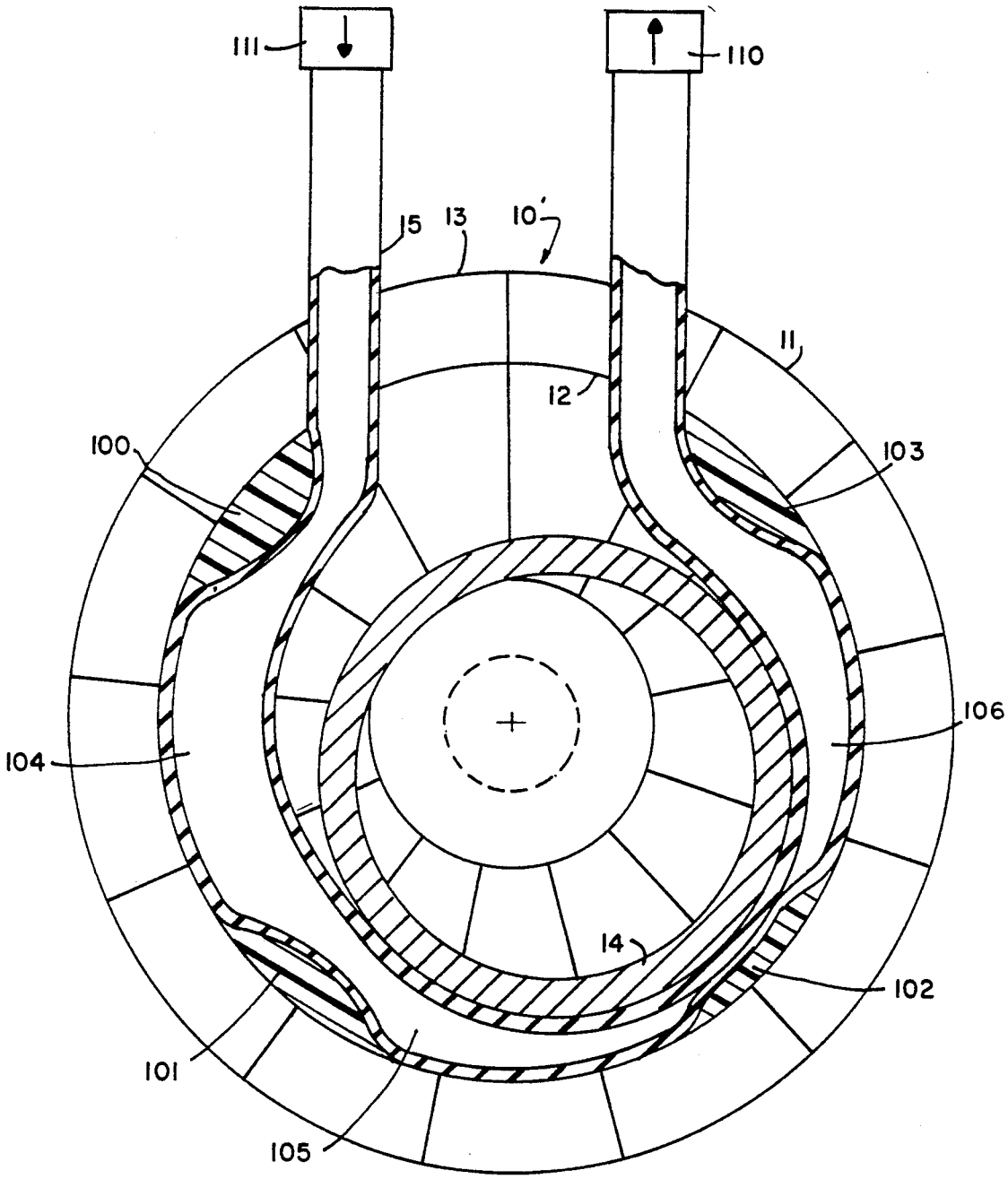
FIG. 5 is a view of another alternative embodiment of the pump depicted in FIG. 1

FIG. 5 discloses another variation of the pump in FIG. 1 that eliminates the need for one-way flow valves such as valves 40 and 41 shown in FIG. 1. In FIG. 5 like reference numerals are used to indicate structures that have analogous structure shown in FIG. 1. Thus, the pump 10' shown in FIG. 5 contains a stator 11 that forms an internal wall 12 circumscribed by a plurality of magnetic field generators 13. A compression roller 14, formed of a permanent magnet or other magnetic material is adapted for rotating inside the pump 10' to progressively depress a flexible diaphragm 15.

In this particular embodiment, valve structures 100 through 103 are disposed at various positions around the interior of the wall 12. Each valve structure is formed as inwardly extending appendage intermediate the wall 12 and the flexible diaphragm 15 and normally would be composed of a compressible material, such as an elastomer. As the compression position produced by the compression roller 14 passes each of these valves 100 to 103, it essentially seals the diaphragm 15 against a corresponding valve structure by compressing the diaphragm 15 and the valve structure and produces a discrete pumping volume. More specifically, the valves 100 and 101 form a pumping volume 104; the valves 101 and 102, a pumping volume 105; and the valves 102 and 103, a pumping volume 106. Thus as shown in FIG. 5, the compression roller 14 seals the flexible diaphragm 15 at the valve structure 102 by compressing the diaphragm 15 and valve structure 102 and isolates the pumping volumes 105 and 106. The remaining valve structures 100, 101 and 103 are in a relaxed, expanded state.

Further rotation in a counterclockwise direction causes the compression roller 14 to advance the compression position in a counterclockwise fashion and pumps fluid out an outlet port 110. At the same time the volume of the flexible diaphragm 15 clockwise of the valving structure 102 expands so fluid enters an inlet port 111. As the compression roller 14 rotates to a position intermediate the inlet and outlet ports 110 and 111 it simultaneously compresses the flexible diaphragm 15 and the valve structures 100 and 103 thereby to prevent any back flow through pump 10'. This structure again produces a peristaltic type of pumping action, but eliminates the need for any input and output one-way flow control valves such as valves 40 and 41 shown in FIG. 1. The ports 110 and 111 can simply comprise fluid couplings.

Each of the specifically disclosed embodiments describes a particular pump including single-stage pumps 10 and 10' in FIGS. 1 and 5 and a multistage pump 50 in FIG. 4. Each pump includes a stator that has a cylindrical wall portion extending along a pump axis and a plurality of magnetic field generators that are equally spaced about the stator for producing magnetic fields within the wall parallel to the pump axis. In FIGS. 1 and 5 the stators 13 have an internal wall portion 12 and include independent field generators 13(*i*) extending about the pump axis 25. Each pump includes a compression roller such as the compression roller 14 in FIGS. 1 and 5 and the compression rollers 90 and 92 in FIG. 4. In each the compression roller moves about the pump axis. Each pump includes a flexible diaphragm such as flexible diaphragm 15 in FIGS. 1 and 5 and flexible diaphragms 74 and 76 in FIG. 4. In each the diaphragm is intermediate a compression roller and the wall and defines a pumping volume with an input port and an output port.

In each pump individual electromagnetic field generators include independent coils that connect to an energizing circuit. The energizing circuit at any given time energizes a plurality of adjacent field generators simultaneously. Over time the energizing circuit advances or sequences the energization of adjacent overlapping sets thereby to produce the rotation of the magnetic field. When a set of adjacent field generators is energized, the compression roller is displaced with respect to the center of the magnetic forces produced by the plurality of adjacent electromagnetic field generators. The displacement rotates within the stator as overlapping sets of adjacent field generators are energized in a sequence.

In accordance with other objects of the invention, each of the pumps is self-contained. There is no need for a separate driving component such as a motor. Each pump also utilizes a peristaltic pumping action. As the compression rollers do not need to close a flexible diaphragm fully, shear forces on the fluid being pumped is minimized. Metal-to-metal contact is minimized, so each pump operates with minimal noise. As will be apparent, each pump is simply constructed, easy to use and reliable.

As previously indicated, it is possible to construct a pump that provides a peristaltic type pumping action with all or some of the advantages of this invention using the specifically disclosed embodiments or any of a variety of other embodiments. The compression rollers might be freely captured in the structure as shown in FIG. 1, constrained as shown in FIG. 4 or be characterized by other motions. A specific embodiment of an magnetic field generator has been disclosed. Other alternatives are possible. For example, in a two-stage pumping operation using permanent magnetic compression rollers, the axially stage displaced electromagnetic field generators, such as field generators 53 and 64 might be operated with a commonly energized coil. Various check valves or other fluid controlling structures could be substituted for the specifically disclosed one-way flow valves and internal valve structures shown in FIGS. 1 and 5.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A pump comprising stator means having a cylindrical wall portion extending along a pump axis and a plurality of electromagnetic field generating means equispaced about said stator means for producing magnetic fields within said wall portion parallel to the pump axis;

compression roller means comprising a magnetic material capable of motion in said stator about the pump axis;

flexible diaphragm means intermediate said stator means and said compression roller means and disposed along said wall portion for defining a pumping volume with input port mean for receiving fluid to be pumped and outlet port means for discharging fluid under pressure; and means for connecting said plurality of field generating means to energizing means that sequentially energize different overlapping sets of adjacent ones of said electromagnetic field generating means thereby to attract said compression roller means to said stator means and compress a portion of said flexible diaphragm means and that energize each overlapping set in sequence thereby to move said compression roller means and the location of the compressed portion of said flexible diaphragm means around said stator means and pump fluid through the pumping volume.

2. A pump as recited in claim 1 additionally comprising means for constraining the motion of said compression roller means transversely to the pump axis whereby said compression roller means substantially closes said flexible diaphragm at a point of maximum displacement toward said wall portion.

3. A pump as recited in claim 2 wherein said constraining means includes crankshaft means with offset crankpin means for supporting said compression roller means for rotation about the pump axis with respect to said stator means.

4. A pump as recited in claim 1 wherein compression roller means is formed of a magnetically attracted material and only adjacent ones of said electromagnetic field generating means proximate the compressed portion are energized simultaneously.

5. A pump as recited in claim 1 wherein compression roller means is formed of a permanent magnet and a first set of adjacent ones of said electromagnetic field generating means proximate the compressed portion are energized to produce a magnetic field of one polarity and the remaining ones of said electromagnetic field generating means are energized to produce a magnetic field of an opposite polarity thereby to attract and repel said compression roller toward the compressed portion.

6. A pump as recited in claim 1 wherein said each of said inlet and outlet port means contains check valve means for controlling fluid flow.

7. A pump as recited in claim 1 wherein said diaphragm includes internally disposed valve structures that close when said compression roller means passes each such valve structure.

8. A pump as recited in claim 1 wherein each of said electromagnetic field generating means comprises an axially extending central portion and first and second radially extending flange portions, said flange portions being disposed at opposite ends of said central portion for generating a magnetic field through said stator that parallels the pump axis and interacts with said compression roller means.

9. A pump comprising:

stator means having a cylindrical wall portion extending along a pump axis;

first and second axially spaced flexible diaphragm means at said cylindrical wall portion for defining a pumping volume with input port means for receiving fluid to be pumped and outlet port means for discharging fluid under pressure;

first and second compression rollers for compressing said first and second diaphragm means respectively, crankshaft means mounted to said stator means for rotation about the pump axis, said crankshaft means including first and second angularly displaced crankpin means for supporting said compression rollers for rotation about the pump axis, a plurality of electromagnetic field generating means equispaced about said stator means for producing magnetic fields within said wall portion parallel to the pump axis;

means for connecting said plurality of field generating means to energizing means that sequentially energize different overlapping sets of adjacent ones of said electromagnetic field generating means associated with each of said roller compression means in sequence thereby to rotate said compression roller means and the location of the compressed portion of said flexible diaphragm means around said stator means and pump fluid through the pumping volume.

10. A pump as recited in claim 9 wherein each said compression roller means is formed of a magnetically attracted material and wherein each of said electromagnetic field generating means adapted for magnetic coupling with one of said compression roller means and only adjacent ones of said electromagnetic field generating means proximate one compressed portion produced by one of said compression roller means are energized simultaneously.

11. A pump as recited in claim 9 wherein each of said compression roller means is formed of a permanent magnet having a polar axis that parallels the pump axis and a first set of adjacent ones of said electromagnetic field generating means proximate the compressed portions that are energized to produce magnetic fields of one polarity and the remaining ones of said electromagnetic field generating means are energized to produce magnetic fields of an opposite polarity thereby to attract and repel said compression roller toward the compressed portions.

12. A pump as recited in claim 9 wherein said each of said inlet and outlet port means contains check valve means for controlling fluid flow.

13. A pump as recited in claim 9 wherein each of said diaphragms includes internally disposed valve structures that close when a corresponding one of said compression roller means passes each such valve structure.

14. A pump as recited in claim 9 wherein each of said electromagnetic field generating means comprises an axially extending central portion and first and second radially extending flange portions, said flange portions being disposed at opposite ends of said central portion for generating a magnetic field through said stator that parallels the pump axis and interacts with said compression roller means.

15. A pump system comprising:

stator means having a cylindrical wall portion extending along a pump axis and a plurality of electromagnetic field generating means equispaced about said stator means for producing magnetic fields within said wall portion parallel to the pump axis;

first and second compression roller means each comprising a magnetic material capable of motion in said stator about the pump axis;

first and second flexible diaphragm means intermediate said stator means and said first and second compression roller means, respectively, and disposed along said wall portion at axially spaced positions for defining a first and second pumping volumes each with input port means for receiving fluid to be pumped and outlet port means for discharging fluid under pressure; and energizing means connected to said electromagnetic field generating means for sequentially energizing different overlapping sets of adjacent ones of said electromagnetic field generating means thereby to attract said first and second compression roller means and compress a portion of said flexible diaphragm means and that energize each overlapping set in sequence thereby to move said compression roller means and the location of the compressed portion of said flexible diaphragm means around said stator means and pump fluid through the pumping volume.

16. A pump system as recited in claim 15 additionally comprising means for constraining the motion of said compression roller means transversely to the pump axis whereby said compression roller means substantially close said flexible diaphragm at points of maximum displacement toward said wall portion.

17. A pump system as recited in claim 16 wherein said constraining means includes crankshaft means with first and second angularly displaced offset crankpin means for supporting said first and second compression roller means for rotation about the pump axis with respect to said stator means.

18. A pump system as recited in claim 15 wherein compression roller means is formed of a magnetically attracted material and only adjacent ones of said electromagnetic field generating means proximate the compressed portions are energized simultaneously.

19. A pump system as recited in claim 15 wherein compression roller means is formed of a permanent magnet and a first set of adjacent ones of said electromagnetic field generating means proximate the compressed portion are energized to produce a magnetic field of one polarity and the remaining ones of said electromagnetic field generating means are energized to produce a magnetic field of an opposite polarity thereby to attract and repel said compression roller toward the compressed portion.

20. A pump system as recited in claim 15 wherein said each of said inlet and outlet port means contains check valve means for controlling fluid flow.

21. A pump system as recited in claim 15 wherein said diaphragm includes internally disposed valve structures that close when said compression roller means passes each such valve structure.

22. A pump system as recited in claim 15 wherein each of said electromagnetic field generating means comprises an axially extending central portion and first and second radially extending flange portions, said flange portions being disposed at opposite ends of said central portion for generating a magnetic field through said stator that parallels the pump axis and interacts with said compression roller means.

* * * * *